US009920532B1

(12) United States Patent
Conklin

(10) Patent No.: US 9,920,532 B1
(45) **Date of Patent: *Mar. 20, 2018**

(54) SKYLIGHT FRAMING SYSTEM

(71) Applicant: Wayne Conklin, Butler, NJ (US)

(72) Inventor: Wayne Conklin, Butler, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/784,867

(22) Filed: Oct. 16, 2017

Related U.S. Application Data

(63) Continuation-in-part of application No. 14/839,294, filed on Aug. 28, 2015, now Pat. No. 9,797,140.

(51) Int. Cl.

| | |
|---|---|
| ***E04D 13/03*** | (2006.01) |
| ***E06B 3/663*** | (2006.01) |
| ***E04B 7/18*** | (2006.01) |
| ***E06B 3/66*** | (2006.01) |
| ***E06B 3/67*** | (2006.01) |
| *E04D 13/04* | (2006.01) |

(52) U.S. Cl.
CPC ..... *E04D 13/0315* (2013.01); *E04B 7/18* (2013.01); *E04D 13/03* (2013.01); *E06B 3/66* (2013.01); *E06B 3/663* (2013.01); *E06B 3/66304* (2013.01); *E06B 3/6715* (2013.01); *E04D 13/04* (2013.01)

(58) Field of Classification Search
CPC ..... E04D 13/0305; E04D 13/0354; E04D 13/0315; E04D 13/1475; E04D 2003/0837; E04D 2003/0856; E04D 3/08; E04D 13/0325; E04B 7/18; E04B 5/46; E06B 3/66; E06B 3/663; E06B 3/66314; E06B 3/66304; E06B 3/6715; E06B 3/66352; E06B 3/33361; E06B 3/66385; E04C 2/546; E04C 2/421
USPC ..... 52/786.13, 200, 656.9, 172
See application file for complete search history.

(56) References Cited

U.S. PATENT DOCUMENTS

| | | | | |
|---|---|---|---|---|
| 2,193,393 | A | 3/1940 | Danner | |
| 2,618,819 | A | 11/1952 | Goodwillie | |
| 4,073,097 | A * | 2/1978 | Jentoft | E04D 13/0305 52/200 |

(Continued)

FOREIGN PATENT DOCUMENTS

| | | |
|---|---|---|
| AU | B4022989 | 3/1990 |
| AU | B5464990 | 11/1990 |

(Continued)

*Primary Examiner* — Joshua J Michener
*Assistant Examiner* — Matthew J Gitlin
(74) *Attorney, Agent, or Firm* — Goldstein Law Offices, P.C.

(57) ABSTRACT

A skylight assembly, having framing members that define an interior space and rafters that span the interior space between framing members, the framing members having an upper support surface for supporting panes of glass, each pane having at least one structural glass panel and a thermal panel. A structural thermal break connected to each framing member provides a lower support surface. The structural glass panels are fully supported by the upper support surface. The thermal panel is supported by the lower support surface, and is sealed to the upper support surface by a spacer, forming an insulating glass unit therewith. The full support of the structural glass, independent of the support of the thermal panel, allows the skylight to be thermally insulated and walkable.

20 Claims, 11 Drawing Sheets

(56) References Cited

U.S. PATENT DOCUMENTS

| | | | | | |
|---|---|---|---|---|---|
| 4,074,480 | A | | 2/1978 | Burton | |
| 4,222,213 | A | | 9/1980 | Kessler | |
| 4,294,649 | A | | 10/1981 | Sarka | |
| 4,409,767 | A | * | 10/1983 | Jentoft | E04D 13/0305 52/200 |
| 4,431,691 | A | | 2/1984 | Greenlee | |
| 4,479,988 | A | | 10/1984 | Dawson | |
| 4,520,602 | A | | 6/1985 | Miller | |
| 4,549,379 | A | * | 10/1985 | Hoy | E04D 13/0305 52/200 |
| 4,589,238 | A | * | 5/1986 | Sampson | E04D 13/0305 52/200 |
| 4,702,049 | A | * | 10/1987 | Sampson | E04D 13/0305 52/200 |
| 4,994,309 | A | | 2/1991 | Reichert et al. | |
| 4,995,208 | A | * | 2/1991 | Sampson | E04D 13/03 52/200 |
| 4,999,964 | A | | 3/1991 | Taylor | |
| 5,003,744 | A | | 4/1991 | Taylor | |
| 5,042,210 | A | | 8/1991 | Taylor | |
| 5,044,133 | A | * | 9/1991 | Sampson | E04D 13/0305 49/495.1 |
| 5,046,292 | A | * | 9/1991 | Sampson | E04D 13/0305 52/200 |
| 5,087,489 | A | | 2/1992 | Lingemann | |
| 5,088,258 | A | | 2/1992 | Schield et al. | |
| 5,103,603 | A | * | 4/1992 | Verby | E04D 13/0354 52/200 |
| 5,207,036 | A | | 5/1993 | Sampson et al. | |
| 5,216,855 | A | * | 6/1993 | Richter | E04D 13/0305 49/DIG. 2 |
| 5,218,806 | A | | 6/1993 | Taylor | |
| 5,424,111 | A | | 6/1995 | Farbstein | |
| 6,263,623 | B1 | * | 7/2001 | Weiss | E04D 13/02 49/463 |
| 6,389,770 | B1 | * | 5/2002 | Santavicca | E04L 31/0046 52/13 |
| 8,225,561 | B2 | | 7/2012 | Voegele, Jr. et al. | |
| 8,291,674 | B2 | | 10/2012 | Valentz et al. | |
| 8,381,490 | B2 | | 2/2013 | Back et al. | |
| 8,397,468 | B2 | | 3/2013 | McClure | |
| 8,701,362 | B2 | | 4/2014 | Stone | |
| 2006/0272232 | A1 | | 12/2006 | Fooks | |
| 2009/0110866 | A1 | | 4/2009 | Ainz et al. | |
| 2010/0269426 | A1 | * | 10/2010 | Richter | E04D 13/0315 52/171.3 |
| 2013/0118101 | A1 | * | 5/2013 | Mitchell | E06B 7/14 52/209 |
| 2014/0109499 | A1 | | 4/2014 | Nieminen et al. | |

FOREIGN PATENT DOCUMENTS

| | | |
|---|---|---|
| CA | 2015714 | 11/1990 |
| CA | 1328970 | 5/1994 |
| EP | 0356374 | 2/1990 |
| EP | 0396075 | 11/1990 |
| GR | 3017183 | 11/1995 |
| IE | 62450 | 2/1995 |
| IE | 67796 | 5/1996 |
| MX | 165468 | 11/1992 |
| MX | 172717 | 1/1994 |
| NZ | 230417 | 3/1993 |
| WO | WO2004042164 | 5/2004 |
| WO | WO2005019561 | 3/2005 |
| WO | WO2007011561 | 1/2007 |
| WO | WO2009056186 | 5/2009 |
| WO | WO2012041325 | 4/2012 |
| WO | WO2014066385 | 5/2014 |

* cited by examiner

SKYLIGHT FRAMING SYSTEM

CROSS REFERENCES AND RELATED SUBJECT MATTER

This application is a continuation-in-part of patent application Ser. No. 14/839,294, filed in the United States Patent Office on Aug. 28, 2015, which is incorporated by reference herein in its entirety.

TECHNICAL FIELD

The present disclosure relates generally to a skylight framing system. More particularly, the present disclosure relates to a framing system for providing a skylight assembly that is both walkable and thermally insulated.

BACKGROUND

Skylights have traditionally been used to provide additional illumination through standard roofing structures. Generally they were not intended, and thus not designed, to support the weight of one or more persons walking upon them.

Over the past several decades, nearly all new windows in residential and commercial buildings have more than one pane of glass and some type of thermally insulative structure or insulating glass unit (IGU). Typically they involve panes of glass separated by a thermal break spacer and sometimes involve evacuating the space in between or filling it with a noble gas such as argon or krypton. As these structures are typically not load bearing, the materials used to fabricate such structures are generally lightweight and can be produced off-site in a manufacturing facility.

Modern trends in building design often desire making rooftop surfaces into useable and even public spaces. This goal has made "walkable" skylights part of more and more building designs.

Walkable skylights must be designed to support the additional loading potential of numerous people walking and standing upon them. Accordingly, typically several layers of thick glass are employed. Supporting these glass panels requires robust framework.

Unfortunately, thick heavy glass, being supported by robust framework is incompatible with current thermal glass technology, such as currently used to create insulating glass units. Thus, while architects desire the aesthetics and functionality of walkable skylight units, such aspirations must compete with the goal of creating an energy efficient building.

My U.S. Pat. Nos. 9,441,378 and 9,598,867 demonstrate systems that provide walkable skylight structures while maintaining thermally insulative properties.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a skylight framing system that is both walkable and energy efficient. Accordingly, the present disclosure provides a framing system that supports heavy duty, load bearing, structural glass panels, and provides separate support for one or more thermal panels adjacent to the load bearing glass.

It is another aspect of an example embodiment in the present disclosure to provide a skylight framing system that provides heat insulating properties. Accordingly, the framing permits creation of insulating glass units (IGU) with structural glass panels and thermal glass panels, and the system employs glass setting blocks configured to work in conjunction with the framing, the structural glass, and thermal panels.

Accordingly, the present disclosure describes a skylight assembly, having framing members that define an interior space and rafters that span the interior space between framing members, the framing members having an upper support surface for supporting panes of glass, each pane having at least one structural glass panel and a thermal panel. A structural thermal break connected to each framing member provides a lower support surface. The structural glass panels are fully supported by the upper support surface. The thermal panel is supported by the lower support surface, and is sealed to the upper support surface by a spacer, forming an insulating glass unit therewith. The full support of the structural glass, independent of the support of the thermal panel, allows the skylight to be thermally insulated and walkable.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1A:
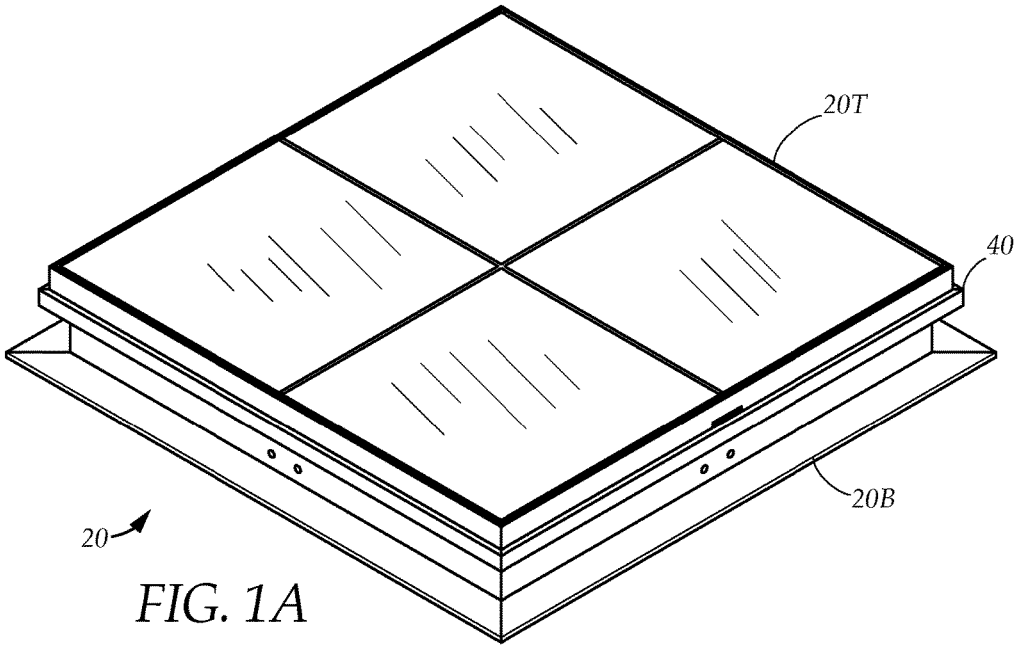
FIG. 1A is a diagrammatic perspective view, showing the skylight assembly, generally from above, showing an exterior of the framing system.
Figure 1B:
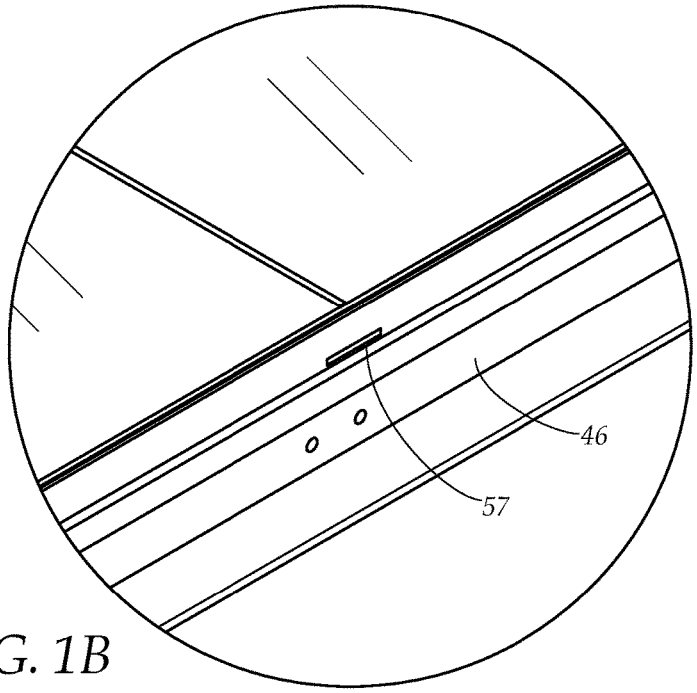
FIG. 1B is an enlargement taken from FIG. 1A, showing one of the weep holes in one of the framing members.
Figure 4:
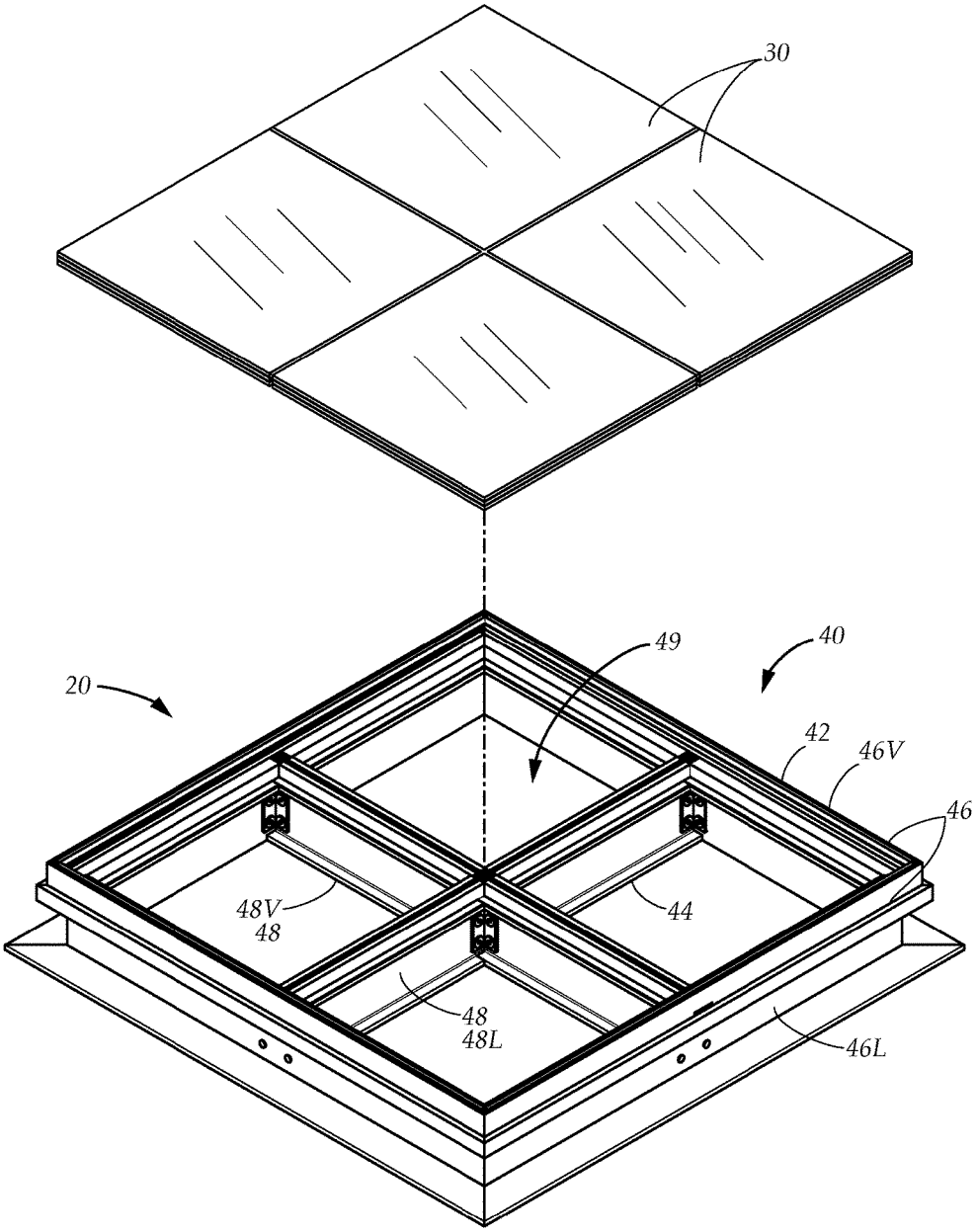
FIG. 4 is an exploded perspective view, illustrating the skylight frame and skylight panes.

FIG. 1A and FIG. 4 illustrate a skylight unit 20. The skylight unit has a top 20T and a bottom 20B. The skylight unit 20 includes a frame 40 and a plurality of skylight panes 30, which each may include several layers, sheets, lites, or panels of glass, as will be described hereinafter.

The frame 40 includes an outer frame 42 and an inner frame 44. The outer frame 42 includes several framing members 46, namely a pair of longitudinal framing members 46L and a pair of transverse framing members 46V. The framing members 48 together define an interior space 49, which is generally spanned by the panes 30. The inner frame 44 extends between and within the outer frame 42—within the interior space 49, and includes rafters 48, namely transverse rafters 48V and at least one longitudinal rafter 48L. The framing members 46L, 46V, and rafters 48L, and 48V are all configured to support the skylight panes 30 in a manner that will be described in detail hereinafter.

Figure 2:
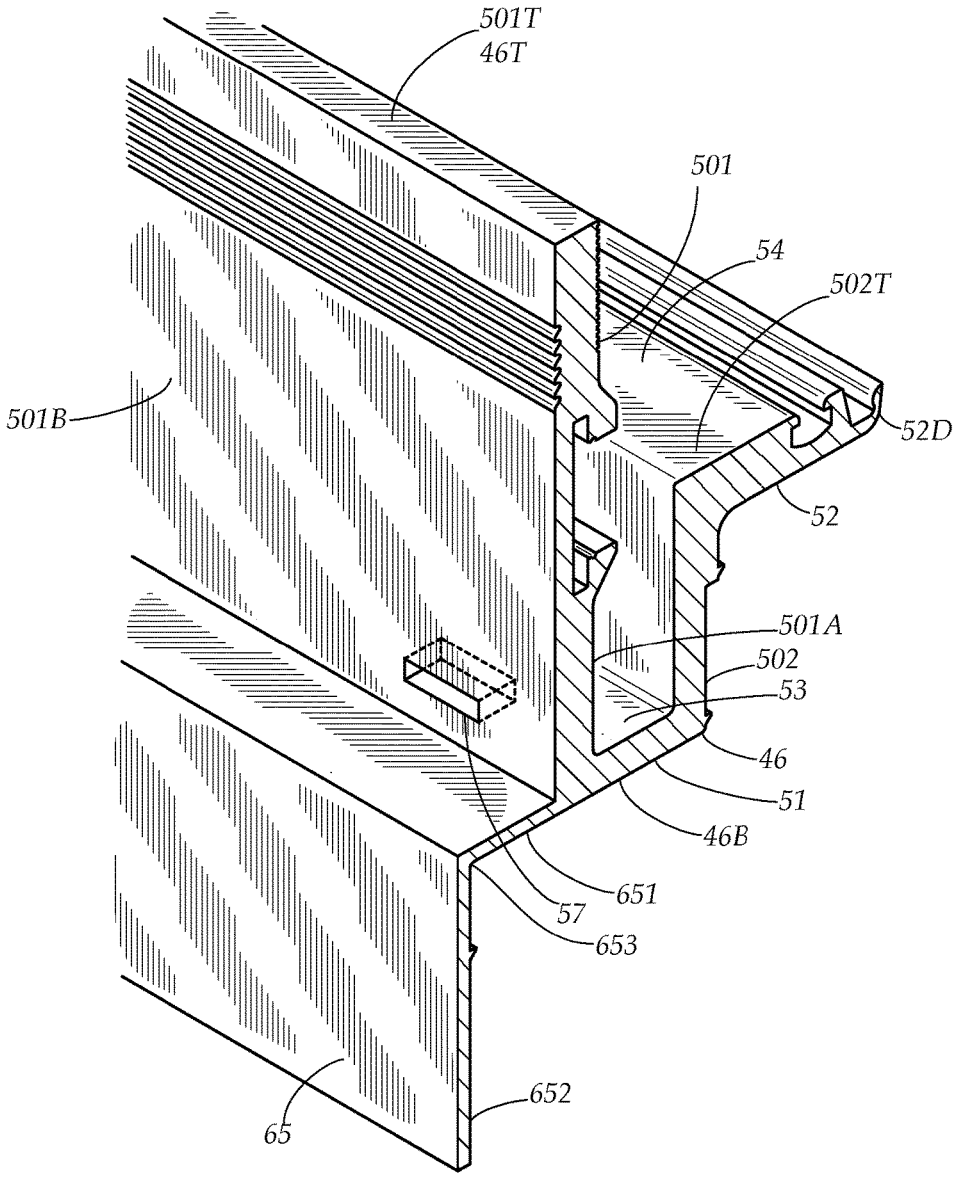
FIG. 2 is a diagrammatic perspective view, showing one of the framing members.

Referring to FIG. 2, framing member 46 is illustrated, having a top 46T, a bottom 46B, a first vertical portion 501, a second vertical portion 502, and an upper support shelf 52 extending laterally from the second vertical portion 502. The framing member 46 has a bottom portion 51 that extends horizontally. The first vertical portion 501 and the second vertical portion 502 both extend upwardly from the bottom portion 51, and extend parallel to each other. The first vertical portion 501 has a top 501T and the second vertical portion 502 has a top 502T. Note that the second vertical portion 502 is shorter than the first vertical portion 501. The first vertical portion 501 has an inward face 501A and an outward face 501B. Accordingly, with the inward face 501A establishing an inward direction with respect to the first vertical portion 501 and the outward face 501B establishing an outward direction, it is clear that the upper support shelf 52 extends inwardly from the second vertical portion 502 at the second vertical portion top 502T. The upper support shelf 52 has an upper support surface 54 and a distal end 52D at a point furthest from the second vertical portion 502.

Figure 3:
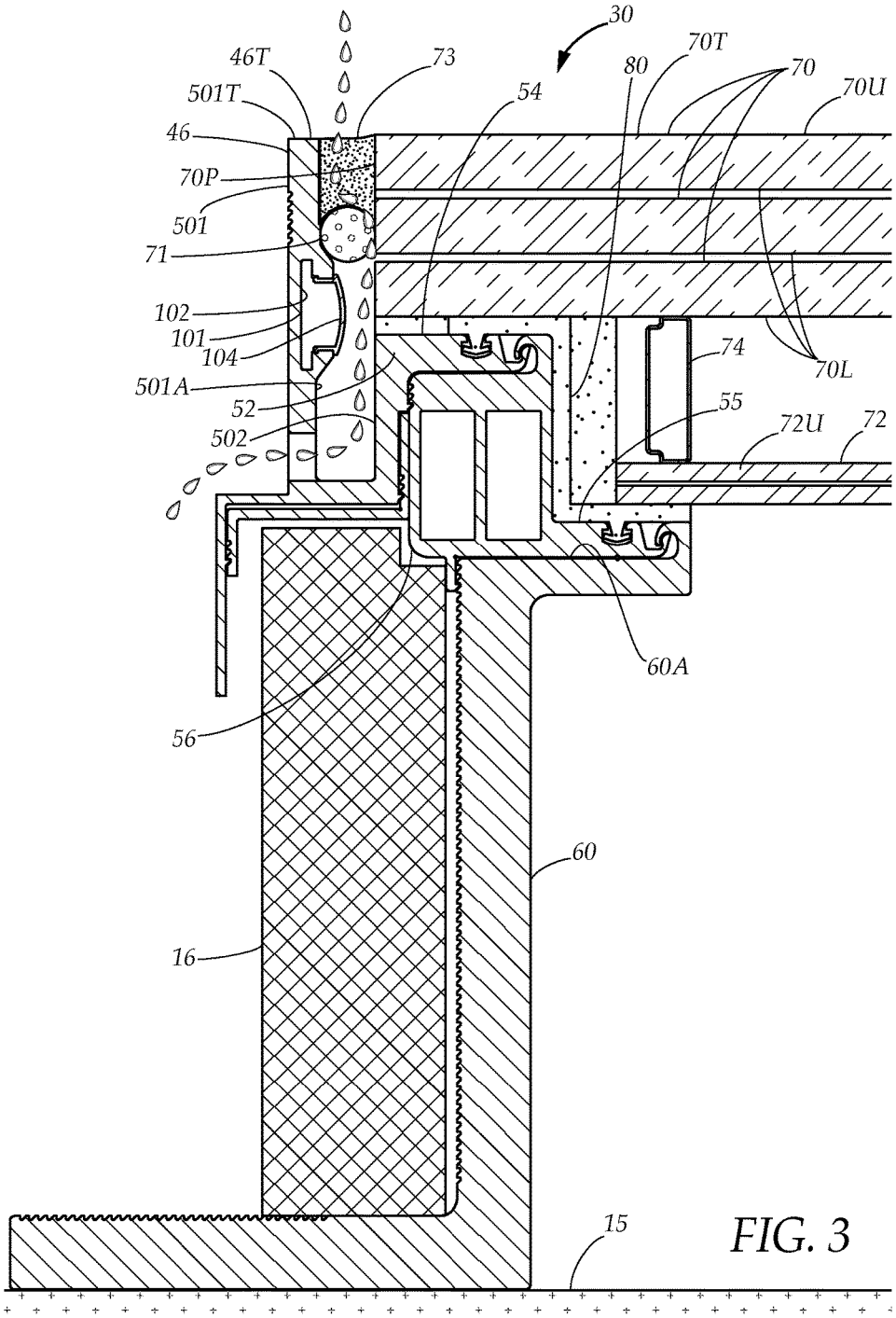
FIG. 3 is a cross sectional view with parts broken away, illustrating components of the skylight assembly, and illustrating a path for water infiltration into the skylight to exit through one of the weep holes, according to the present disclosure.

The first vertical portion 501, second vertical portion 502, and bottom portion 51 together define a main gutter 53. Each framing element also has at least one weep hole 57 (also see FIG. 1A) that extends fully between the inward face 501A and outward face 501B of the first vertical segment 501, preferably at or just above the bottom portion 51, such that water can drain from the main gutter 53 to outside the framing member 46. The framing member 46 also has a flashing overhang 65 that has a horizontal leg 651 that extends laterally outwardly from the outward face of the first vertical portion 501, a right angle bend 653, and then a downward leg 652 that extends downwardly therefrom and perpendicular to the horizontal leg 651. The flashing overhang 65 provides an offset that can be used to cover a building element such as an insulation block 16 (as shown in FIG. 3). Advantageously it allows integration with building waterproofing systems, such as by allowing a waterproofing membrane to be extended upwardly under the overhang to keep in line with waterproofing best practices.

Figure 8:
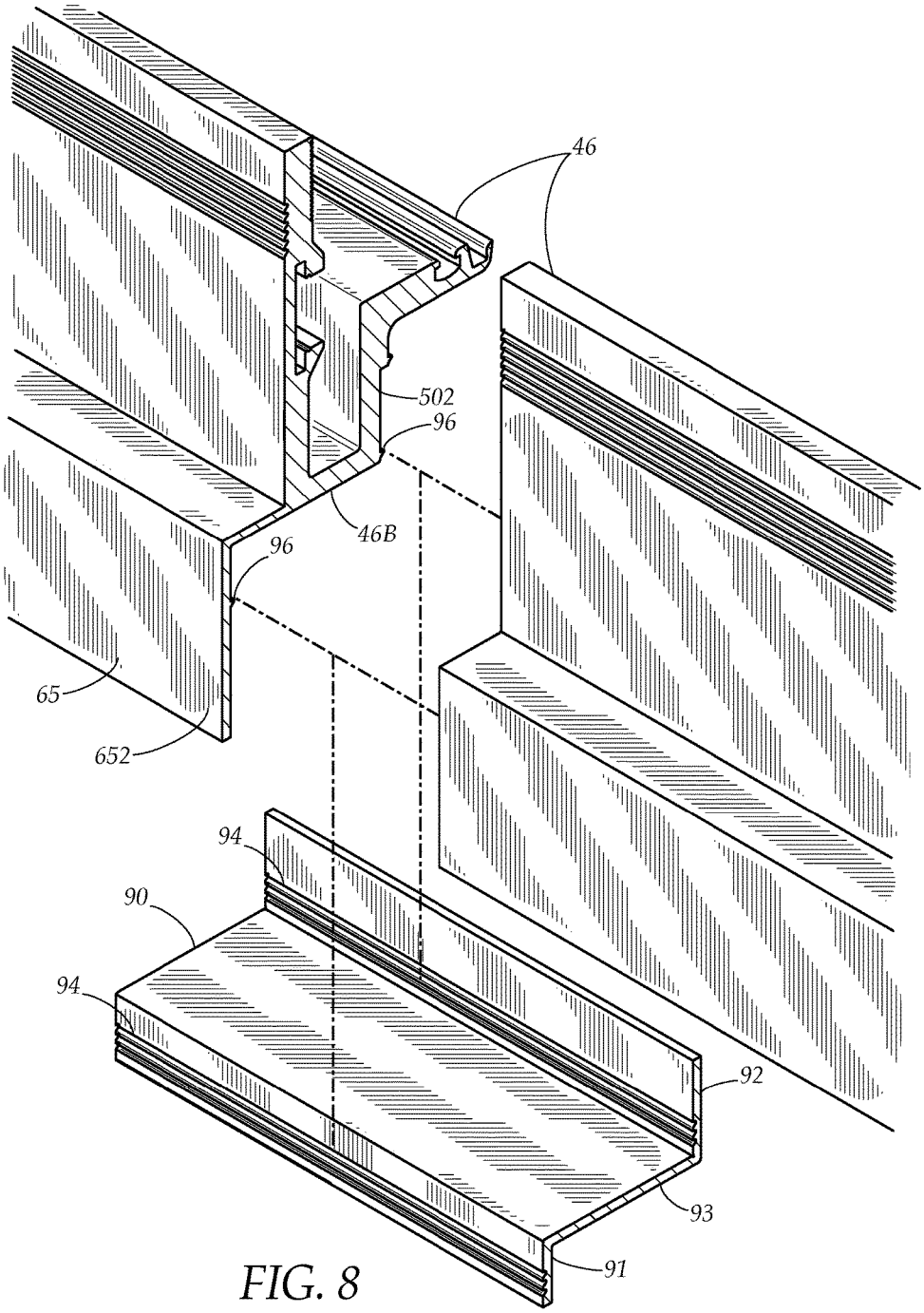
FIG. 8 is a diagrammatic perspective view, illustrating two of the framing members being joined and sealed with a bottom plate.

Referring to FIG. 8, a bottom plate 90 may be provided to help seal gaps between adjacent framing members 46. In particular, in a long span, when two adjacent framing members 46 must be joined, the bottom plate 90 is mated both framing members 46 that abut each other to prevent water leakage therebetween. The version of the bottom plate 90 shown in FIG. 8 is a rectangular version best suited for mating two parallel, abutting framing members 46. Note that an alternate "corner" version can be provided for use when two framing members 46 meet at right angles, and are mitered together.

The bottom plate 90 includes an outer panel 91, an inner panel 92, and a horizontal panel 93. The outer panel 91 and inner panel 92 extend at right angles to the horizontal panel 93, the outer panel 91 extending downwardly and the inner panel 92 extending upwardly. The outer panel 91 and inner panel 92 both having longitudinal ridges 94. The downward leg 652 of the flashing overhang 65 and the second vertical portion 502 each have a longitudinal rib 96. Accordingly, installation of the bottom plate 90 involves covering the horizontal panel 93 with silicon sealant and then pressing the bottom plate 90 upwardly against the framing members 46, positioned laterally to extend an even width onto each of the abutted framing members 46. The horizontal panel 93 is pressed up against the bottom 46B of the framing member as the outer panel 91 is engaged with the downward leg 652 and the inner panel 92 is engaged with the second vertical portion 502 until the longitudinal ribs 96 engaged with the ridges 94 and the bottom plate 90 snaps into place.

Referring now to FIG. 3, associated with each framing member 46 is a base frame member 60. The base frame member 60 is generally anchored to a building structure 15 and provides load bearing support for the framing member 46 and partially supports the skylight assembly 20 in general. The base frame member 60 can be configured in numerous ways, including in the shape illustrated, and generally has a base support surface 60A.

Figure 3A:
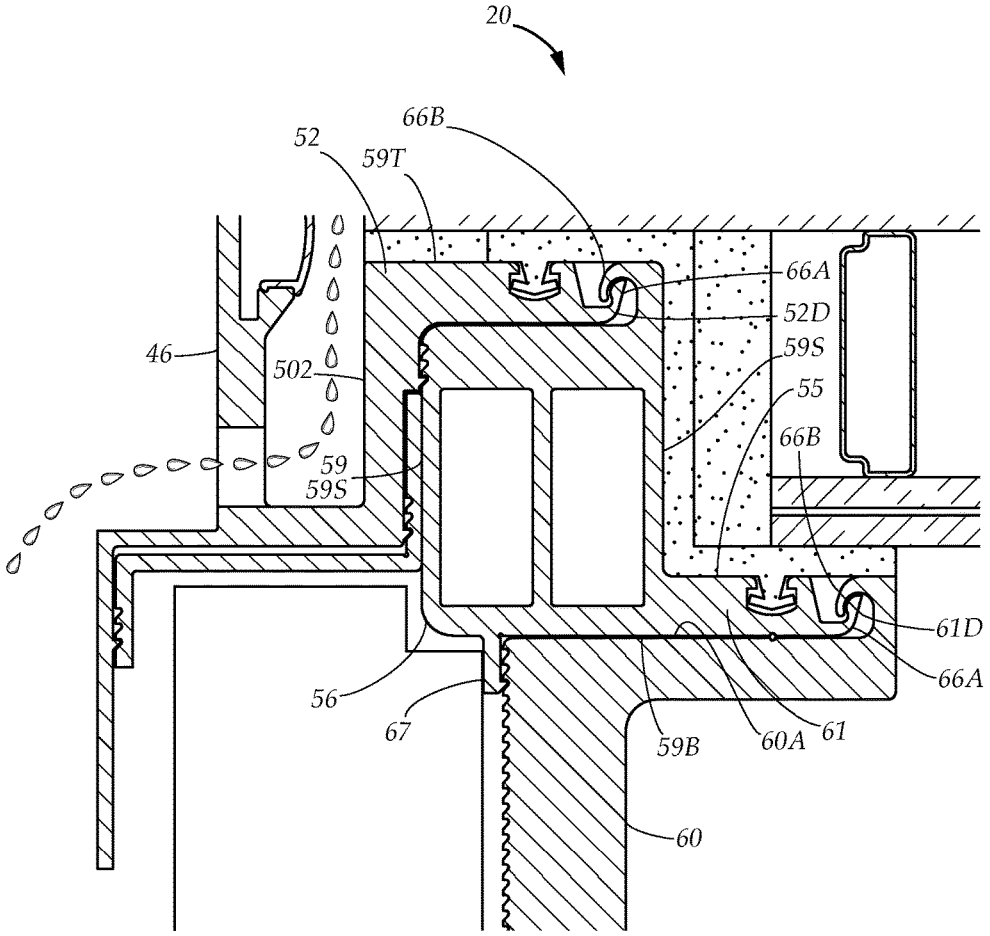
FIG. 3A is a cross sectional view with parts broken way, showing an enlargement of a portion FIG. 3.

Referring to FIG. 3A, a structural thermal break 56 extends underneath the upper support shelf 52 and provides load bearing support for the framing member 46. The structural thermal break 56 sits upon the base support surface 60A of the base frame member 60 and is supported thereby. The structural thermal break 56 has a box portion 59 having a top 59T, sides 59S, a bottom 59B and a lower support shelf 61 that extends inwardly near the bottom 59B and includes a lower support surface 55 and a distal end 61D at a point furthest from the sides 59S of the box portion 59. In addition to the structural thermal break 56 supporting the framing member 46 by the top 59T of the box portion 59 extending beneath the upper support shelf 52, the structural thermal break 56 is connected to the framing member 46 by an upturned clasp 66A at the distal end 52D of the upper support shelf 52 and a downturned clasp 66B on the box portion 59 of the structural thermal break 56. In particular, the clasps 66A, 66B allow this connection by first rotating the structural thermal break 56 counter-clockwise to enter the downturned clasp 66B into the upturned clasp 66A and then rotating the structural thermal break 56 clockwise until the box portion 59 is tucked under the upper support shelf 52, extending snug against both the upper support shelf 52 and the second vertical portion 502. Note that this arrangement effectively cantilevers the structural thermal break 56 from the framing member 46; although it is advantageously also supported from below by the base frame member 60. Note that the base frame member 60 can be similarly secured to the structural thermal break 56, using one of the upturned clasps 66A at the distal end 61D of the lower support shelf 61 and using one of the downturned clasps 66B on the base support surface 60A. The addition of a downward tab 67 extending downwardly from the bottom 59B of the box portion 59 then rotationally steadies the structural thermal break 56 against the base frame member 60.

Again referring to FIG. 3, one of the skylight panes 30 is shown partially supported by the upper support shelf 52 of one of the framing members 46. In particular, this skylight pane 30 includes three heavy, structural glass panels 70, each having a lower surface 70L and one significantly lighter and thinner thermal glass panel 72 that has an upper surface 72U. The structural glass panels 70 are thick and heavy, as they are intended to support the weight of multiple persons walking thereon, as well as providing a significant safety margin for even greater loading. The thermal glass panel 72 is linked to one of the structural glass panels 70 by a spacer 74 that extends against and seals to the lower surface 70L of said structural glass panel 70, and the upper surface 72U of the thermal glass panel 72 to create an insulating glass unit (IGU). Note that the spacer 74 is generally hollow, except for desiccant material contained therein, and cannot support significant weight. Accordingly, the weight of the structural glass panels 70 is not borne by the thermal panel 72, nor is it exerted upon the spacer 74. Instead, the structural glass panels 70 are supported by the upper support surface 54, while the thermal panel 72 is supported by the lower support surface 55. More particularly, however, the structural glass panels 70 and the thermal panel 72 rest upon a glass setting block 80. The glass setting block 80 is made of a rubbery, or rubber-like material, and acts as a gasket—cushioning the glass panels 70, 72 and sealing with the framing member 46. The framing member 46 creates a contour between the upper support surface 54, the structural thermal break 56, and the lower support surface 55. The glass setting block 80 follows this contour and extends between the structural glass panels 70 and upper support surface 54, and between the thermal panel 72 and the lower support surface 55. The glass setting block 80 also extends upwardly from the lower support surface 55, alongside the structural thermal break 56, to the upper support surface 54. Preferably protrusions and openings on the framing member 46 and glass setting block 80 respectively, as seen in FIG. 3, help mate and maintain the glass setting block 80 in position.

As illustrated in FIG. 3, gaps between the structural glass panels 70 and the first vertical portion 501 are filled with a backer rod 71, generally made of foam or the like, and a clear structural silicon sealant 73. The structural glass panels 70 include an uppermost structural glass panel 70U, having a top surface 70T. Note that the top surface of the uppermost structural glass panel 70U is preferably equal and level in height to the top 501T of the first vertical portion 501. Generally then, the second vertical portion 502 is shorter than the first vertical portion 501 by a distance that is substantially the thickness of the structural glass panels 70 plus the thickness of the glass setting block 80 as it extends upon the upper support surface 54, so that the upper support shelf 52 extending from the second vertical portion 502 is therefore submerged from the top 46T of the framing member 46 by this distance to keep the structural glass panels 70 level with the top 46T of the framing members 46.

The framing member 46 may also have an edge lighting assembly 101 in the inward face 501A of the first vertical portion for providing edgewise illumination of the glass, that may include a lighting channel 102, a translucent lighting lens 104 that selectively covers and extends into the lighting channel 102, and a lighting element such as an LED lighting strip extending within the lighting channel 102. The structural glass panels 70 each have a perimeter edge 70P. The lighting channel 102, the lens 104 and the lighting strip are all directed toward the edges 70P of the structural glass panels 70.

Figure 5:
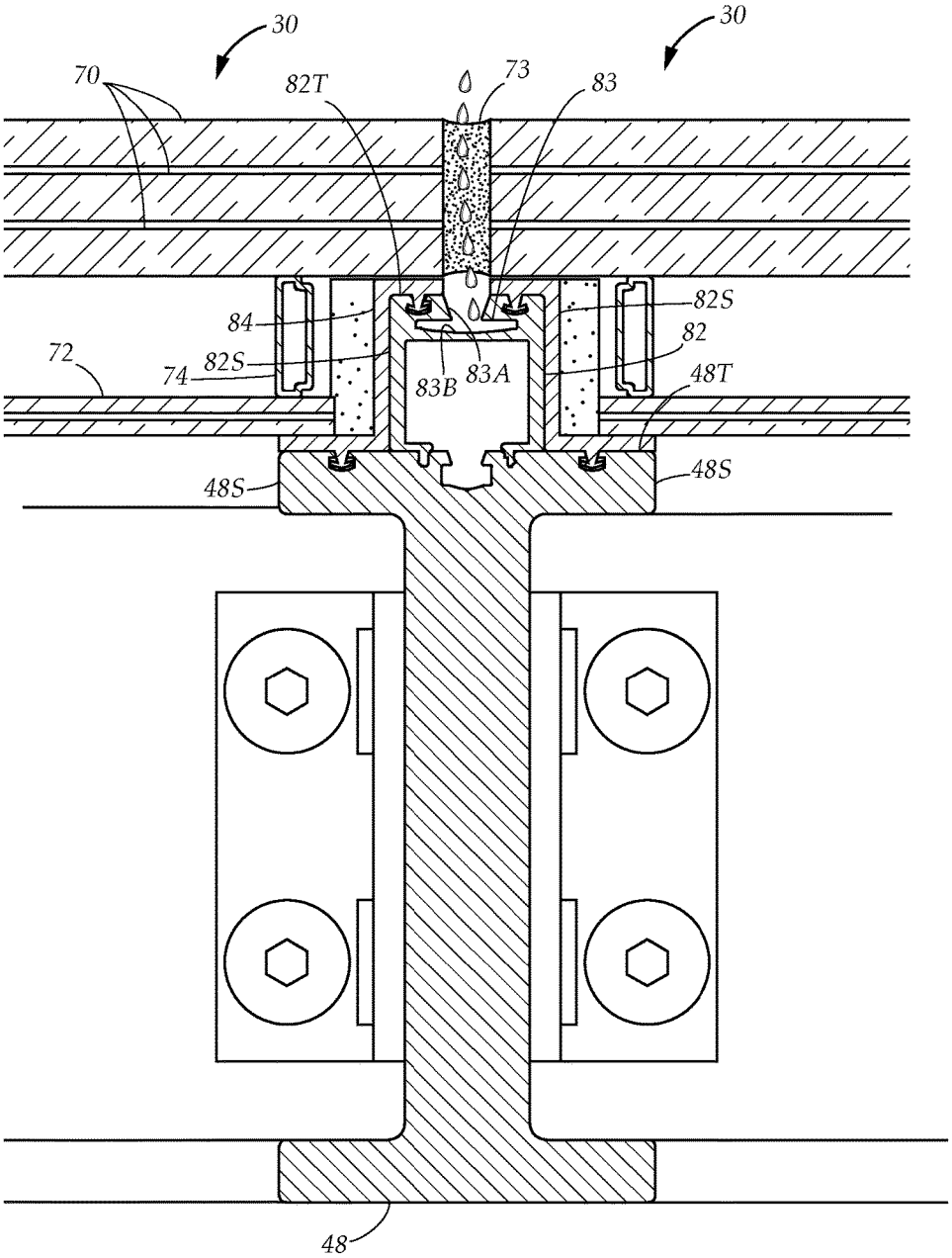
FIG. 5 is a cross sectional view, illustrating support of the skylight panes by the rafters and drainage channels provided thereby.

FIG. 5 shows two adjacent skylight panes 30, as they meet, resting above and supported by one of the rafters 48. The rafter 48 is substantially T-shaped, having a broad rafter top 48T, the rafter top 48T having rafter side edges 48S. A rafter support block 82 is positioned on the rafter top 48T and is substantially centered between the rafter side edges 48S. The support block 82 has a pair of block sides 82S and a block top 82T. Note that as indicated, the support block 82 may be a separate piece of material from the rafter 48, joined to the rafter top 48T by protrusions and openings. The support block 82 may also be formed of a continuous piece of material with the rafter 48.

In the embodiment shown, the support block 82 has a drainage channel 83 having a drainage channel bottom 83B, extending longitudinally near the block top 82T and extending longitudinally therealong. A drainage slot 83A is open upwardly through the block top 82T and thereby allows water to enter the drainage channel 83 therethrough and travel along the drainage channel bottom 83B.

The structural glass panels 70 of the two adjacent skylight panes 30 are supported upon the block top 82T. The thermal glass panels 72 are supported upon the rafters top 48T. A rafter glass setting block 84 is provided to directly support the structural glass panels 70 and thermal glass panel 72 of each pane 30 upon the support block 82 attached on the rafter 48, just as the glass setting block 80 is provided to support them upon the framing members 46 and structural thermal break 56 (as shown in FIG. 3). Like the glass setting block, the rafter glass setting block 84 is made of a rubbery material. The rafter glass setting block 84 is secured to the rafter top 48T, and extends on the rafter top 48T between its associated thermal glass panel 72 and the rafter top 48T. The rafter glass setting block 84 also extends upwardly along one of the block sides 82S of the support block 82 and across the block top 82T to the drainage slot 83A. The thermal panel 72 rests upon the rafter glass setting block 84, and is connected to the nearest structural glass panel 70 (without supporting the weight of the structural glass panel), with the spacer 74 to create an insulating glass unit therewith. Lateral space between structural glass panels 70 of adjacent panes 30 is filled with the silicon sealant 73 or suitable equivalent. Any water that manages to bypass the silicon sealant 73 and infiltrates the skylight assembly 20 will enter the drainage channel 83 through the drainage slot 83A.

In sum, referring to FIG. 3 and FIG. 5 as appropriate: Two adjacent panes 30 are each supported between one of the framing members 46 and the rafter 48. Each pane 30 has three structural glass panels 70, supported by the upper support surface 54 of one of the framing members 46, and the support block 82 on the rafter 48 therebetween. Each pane 30 also has one panel of thermal glass 72 that extends parallel to the structural glass panels 70, supported by the lower support surface 55 of one of the structural thermal breaks 56, and the rafter top 48T of the rafter 48 therebetween. The glass setting block 80 and the rafter glass setting block 84, provide the actual contact with the structural glass 70 and thermal glass 72, as supported on the framing members 46, structural thermal breaks 56, and rafters 48. Accordingly, the structural glass 70 is fully supported by the framing members 46, structural thermal breaks 56, and rafter 48, independently of the support provided to the thermal glass 72. Thus, an insulating glass unit (IGU) is created, without sacrificing the strength and walkability of the structural glass, and without crushing the IGU under the weight of the structural glass and the load it is designed to support.

Figure 7:
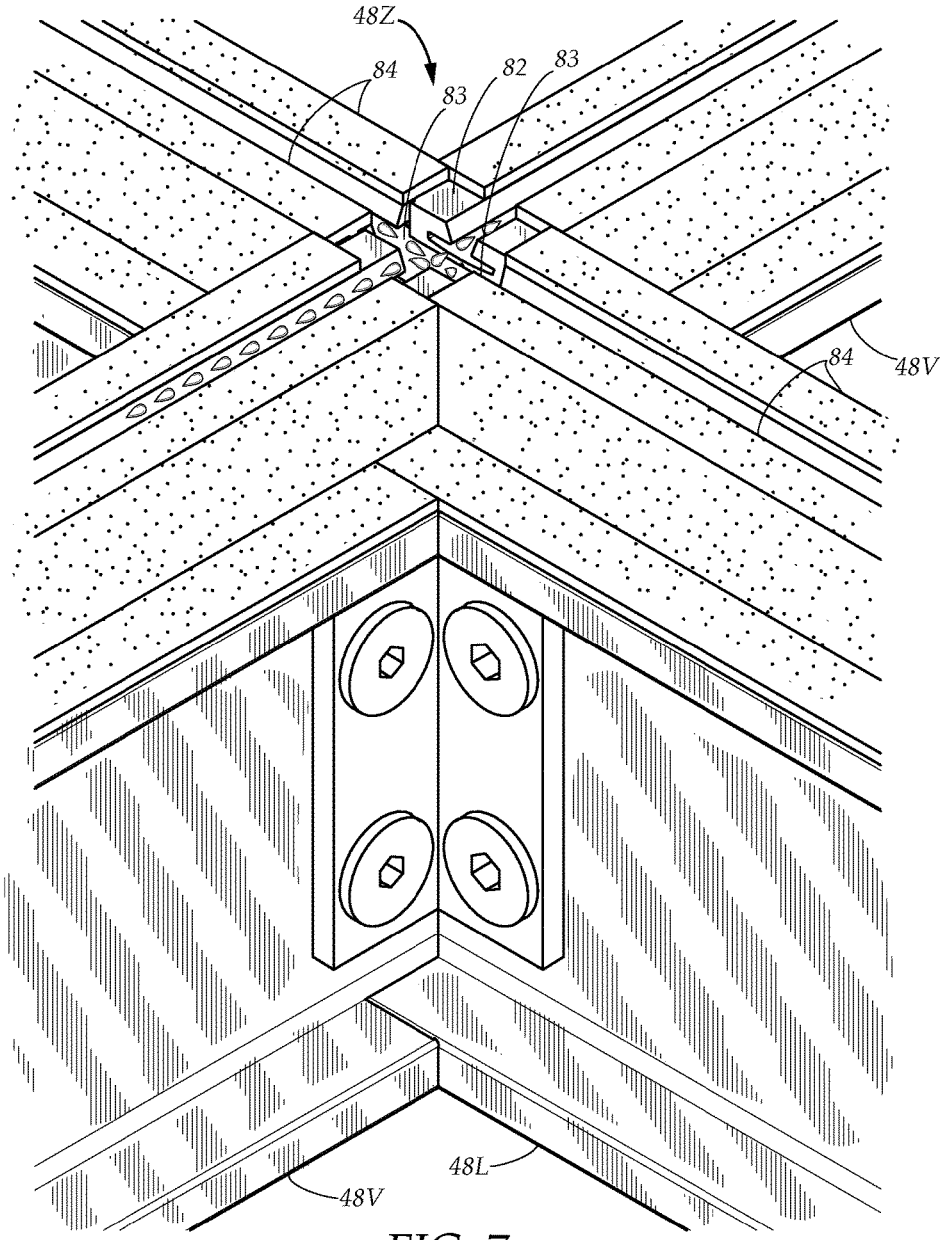
FIG. 7 is a diagrammatic perspective view, illustrating an intersection zone where water from the drainage channels is two of the rafters into the drainage channel of another rafter that they abut.
Figure 9:
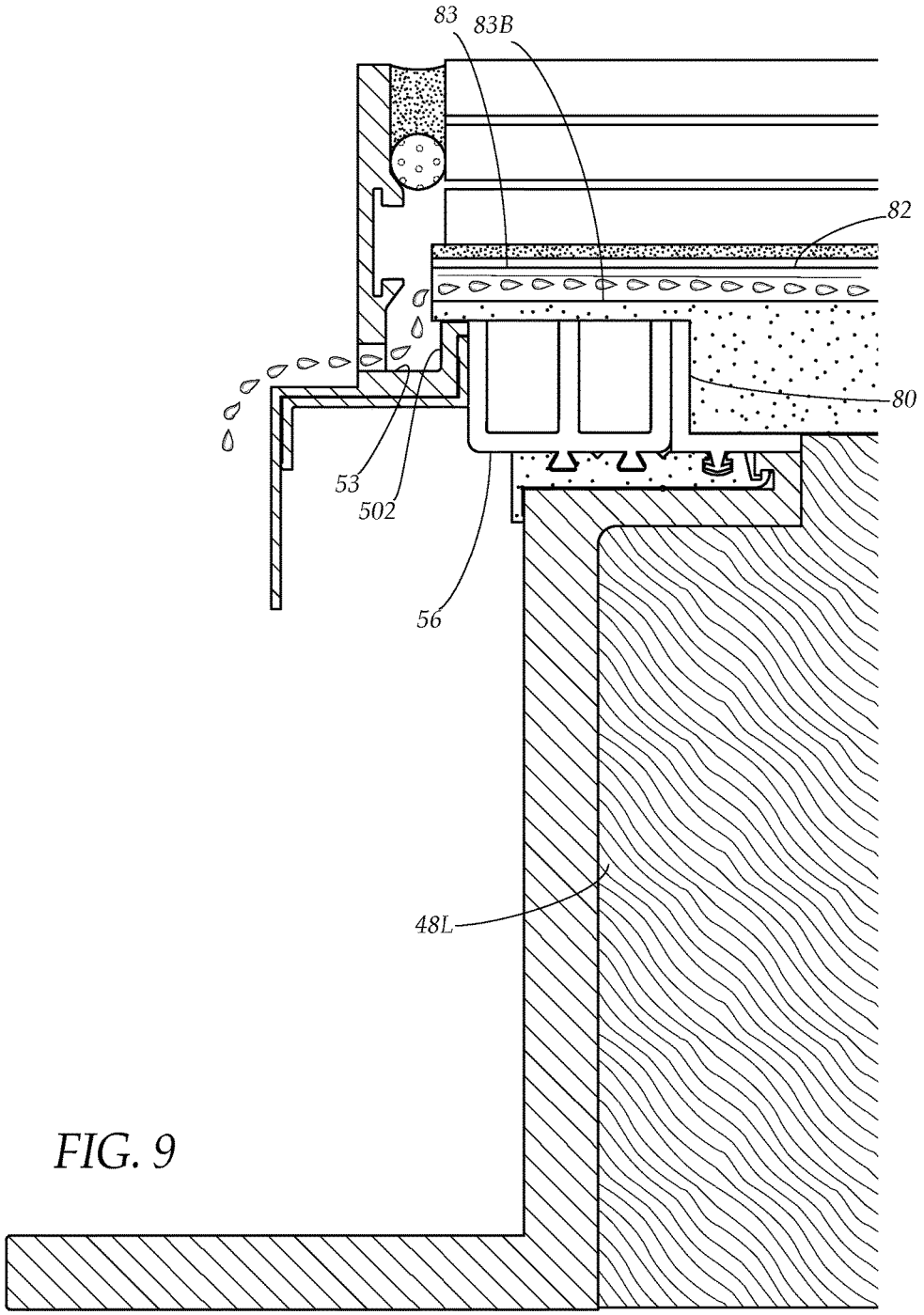
FIG. 9 is a cross sectional view, with parts broken away, illustrating the drainage channels in one of the support blocks carrying water to the gutter in one of the framing members.
Figure 10:
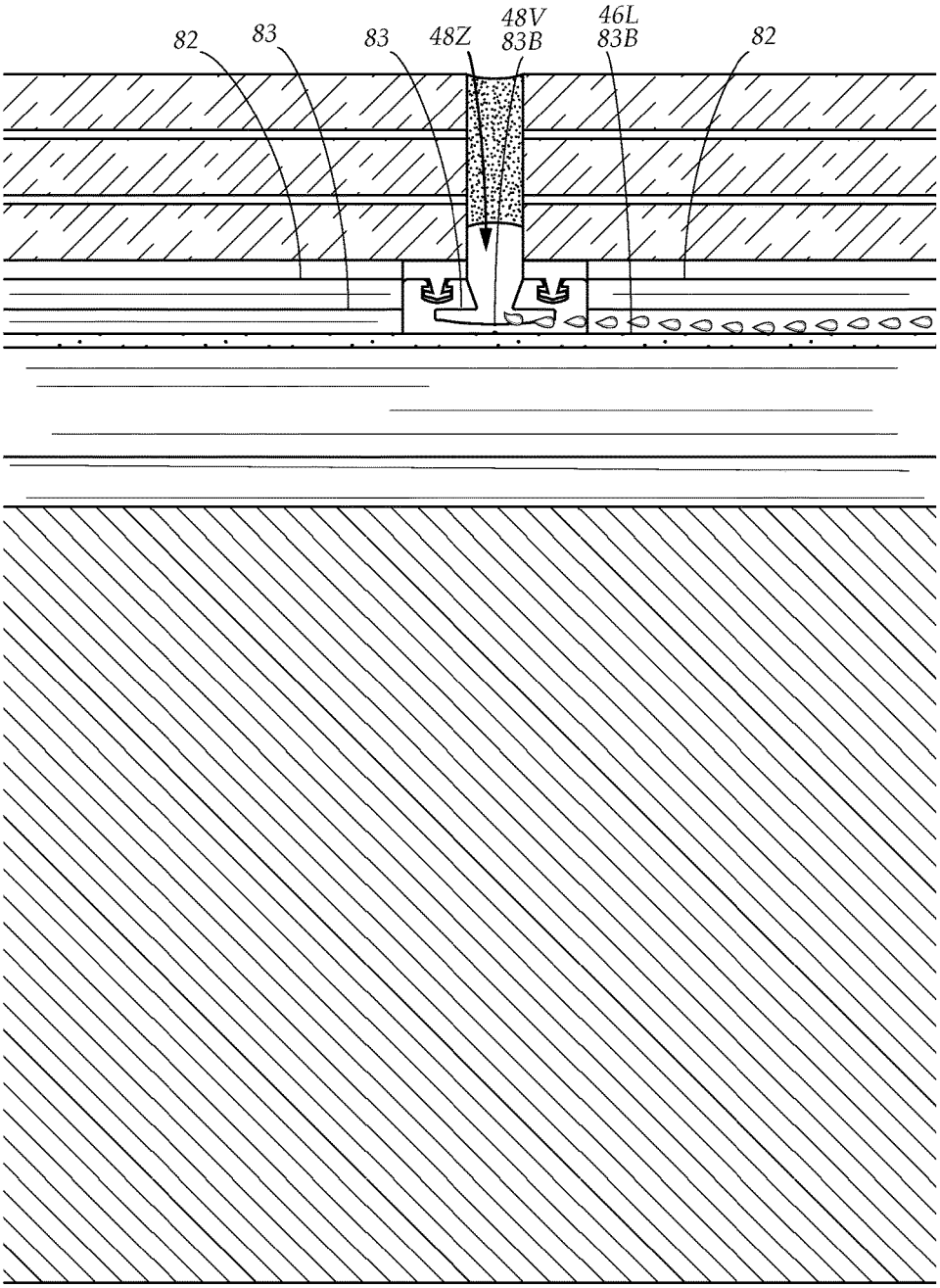
FIG. 10 is a cross sectional view, illustrating the intersection zone and water draining from the higher drainage channel of one of the support blocks to the lower drainage channel of another of the support blocks.

FIG. 7 and FIG. 10 illustrate the rafter support blocks 82 and rafter glass setting blocks 84, attached onto the rafters 48—namely two of the traverse rafters 48V that abut one of the longitudinal rafters 48L at an intersection zone 48Z. The rafter support blocks 82 on the transverse rafters 48V extend onto the longitudinal rafter 48L to abut the rafter support block 82 thereon. The rafter support blocks 82 are also modified at their intersection with appropriate portions notched or cut away so that the drainage channels 83 of the transverse rafters 48V drain into the drainage channels 83 of the longitudinal rafter 48L. Advantageously this is accomplished by having the drainage channel bottom 83B of the longitudinal rafter 48L lower than the drainage channel bottom 83B of the transverse rafters 48V. Accordingly, while portions of the support block 82 of the longitudinal rafter 48L is broken away surrounding the drainage slot, the drainage channel bottom 83B is continuous across the intersection zone 48Z. Thus, water at the drainage channel bottom 83B of the transverse rafters 48V drain into the drainage channel bottom 83B of the longitudinal rafter 48L, where it is carried to the gutter 53 (as shown in FIG. 9). Note that at the intersection zone 48Z, the support blocks 82 of the transverse rafters 48V are appropriately notched to allow the drainage channel 83 to continue past the abutment of the transverse rafter 48V to the longitudinal rafter 48L.

Figure 6:
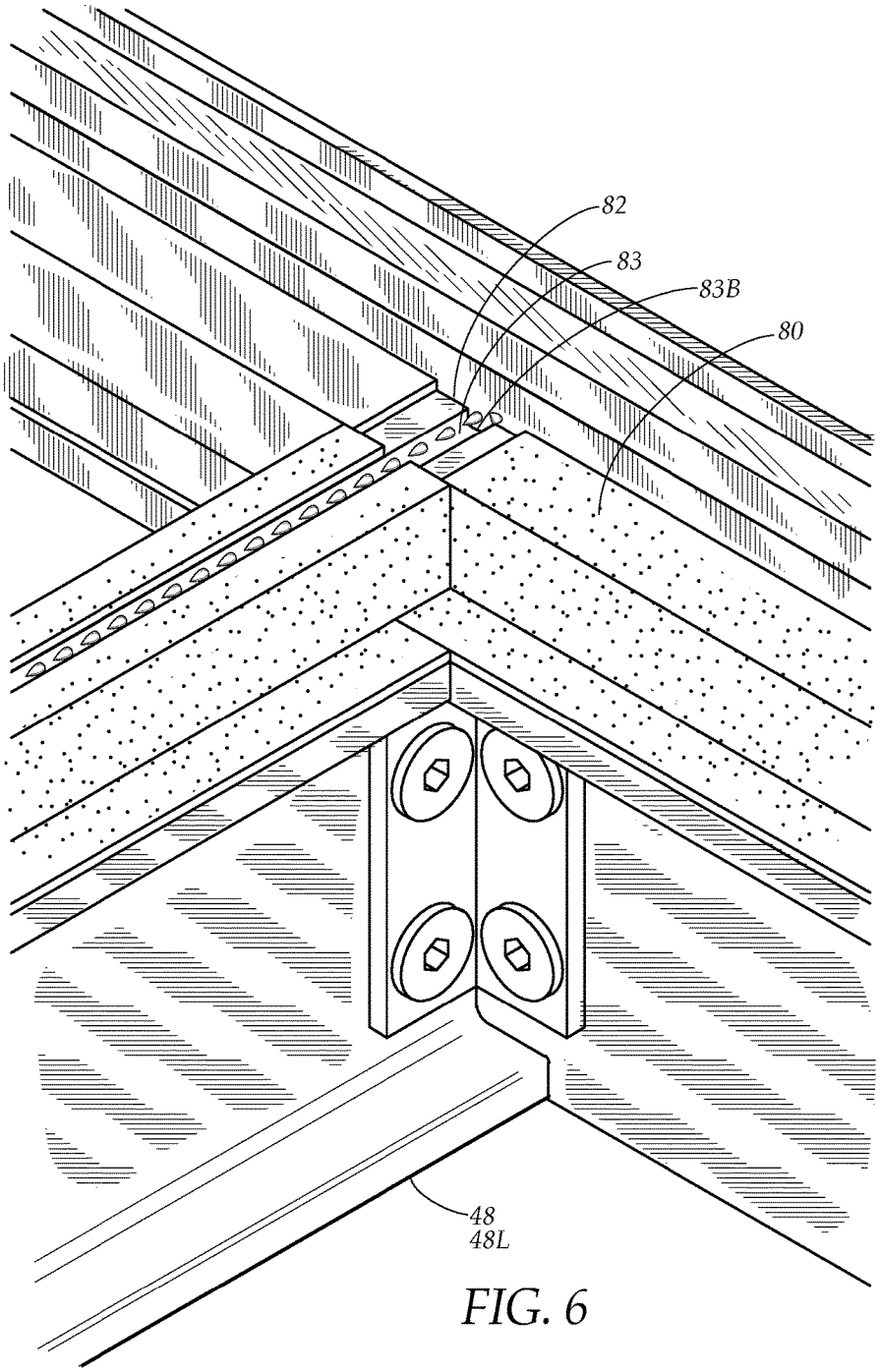
FIG. 6 is a diagrammatic perspective view, illustrating water draining from the drainage channel in the support block on one of the rafters into the gutter of one of the framing members.

As illustrated in FIG. 6 and FIG. 9, the drainage channel 83 of the support block 82 one of the rafters 48 (FIG. 6 only) extends past the second vertical portion 502 in the framing member 46 to drain water into the main gutter 53 of said framing member 53. Accordingly, the second vertical portion 502, the structural thermal break 56, the upper support shelf 52 (FIG. 3), and glass setting block 80 is appropriately notched or broken away to allow the drainage channel 83 and drainage channel bottom 83B to extend past the second vertical portion 502 and into the main gutter 53. In addition, the rafter support block 82 is notched so that a lower portion thereof ends at the glass setting block 80 while an upper portion thereof, that includes the drainage channel 83, continues toward the main gutter 53. Referring to FIG. 4, the skylight unit 20 can be configured so that only the longitudinal rafters 48L drain into the gutters 53 (not seen in FIG. 4) in the framing members 46, or that both the longitudinal rafters 48L and transverse rafters 48V drain into the gutters 53.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a skylight system that is configured to provide thermal insulation while also having the structural strength to be walkable, and also having superior drainage features. The disclosure is illustrated by example in the drawing figures and throughout the written description. It should be understood that numerous variations are possible while adhering to the inventive concept. Such variations are contemplated as being a part of the present disclosure.

What is claimed is:

1. A skylight assembly, comprising:

an outer frame, the outer frame having framing members that define an interior space, the framing members each having a bottom portion, a first vertical portion that extends upwardly from the bottom portion and has an inward face, an outward face, and a first vertical portion top, a second vertical portion that extends upwardly from the bottom portion and has a second vertical portion top, the second vertical portion is parallel to and shorter than the first vertical portion, the framing members each having an upper support shelf that extends inwardly from the second vertical portion top, the upper support shelf having an upper support surface, the outer frame also having a structural thermal break associated with and connected to each framing member, the structural thermal break extending below and against the upper support shelf and the second vertical portion, the structural thermal break having a box portion and a lower support shelf extending laterally from the box portion, substantially parallel to the upper support shelf;

at least one structural glass panel, spanning a portion of the interior space, having a lower edge that is supported by the upper support surface;

a thermal glass panel having an upper edge, the thermal glass panel having a lower edge that is supported by the lower support shelf and extends parallel to the at least one structural glass panel; and a spacer, extending between the at least one structural glass panel and the panel of thermal glass, the spacer extending against and sealed to the lower edge of one of the panels of said at least one structural glass panel and the upper edge of the thermal glass panel to create an insulating glass unit between the thermal glass panel and said at least one structural glass panel.

2. The skylight as recited in claim 1, further comprising a glass setting block, the glass setting block made of a gasket material, the glass setting block following a contour provided by the upper support surface, the structural thermal break, and the lower support shelf, the glass setting block extending between the upper support surface and one panel of the at least one structural glass panel, and between the lower support shelf and the thermal glass panel.

3. The skylight as recited in claim 2, further comprising an inner frame, the inner frame including at least one rafter extending between two of the framing members, the rafter including a rafter top, rafter side edges, and a support block positioned on the rafter top and substantially centered between the rafter side edges, the support block having a pair of block sides and a block top, the at least one structural glass panel resting upon the block top, the thermal glass panel resting upon the rafter top.

4. The skylight as recited in claim 3, further comprising a pair of rafter glass setting blocks associated with the at least one rafter, the rafter glass setting block made of a gasket material, secured to the rafter top, and extending on the rafter top between one of the thermal glass panels and the rafter top, upwardly along one of the block sides, and partially across the block top between the at least one structural glass panels and block top.

5. The skylight as recited in claim 4, wherein each framing member has a framing member top, wherein the structural glass panels extend alongside and inwardly of the first vertical portion, wherein the at least one structural glass panel includes an uppermost structural glass panel having an uppermost structural glass panel top that is substantially level in height with the first vertical portion top.

6. The skylight as recited in claim 5, wherein each framing member has a flashing overhang that has a horizontal leg that extends laterally outwardly from the first vertical portion, and a downward leg that extends downwardly from and perpendicular to the horizontal leg fully opposite from the first vertical portion.

7. The skylight as recited in claim 6, wherein each structural thermal break has a top, a bottom, and a downward clasp at the top, wherein the upper support shelf of each framing member has an upward clasp, and wherein the downward clasp of each of the structural thermal breaks is mated with the upward clasp of one of the framing members.

8. The skylight as recited in claim 7, wherein the outer frame includes two framing members that extend parallel to and abut each other, and further comprising a bottom plate that has an outer panel that extends downwardly, an inner panel that extends upwardly, and a horizontal panel that extends between the inner panel and outer panel, the bottom plate extends underneath both of said framing members that abut each other with the horizontal panel extending against the bottom of said framing members, the inner panel extending against the second vertical portions of said framing members, and the inner panel extending against the downward leg of the flashing overhang of said framing members.

9. The skylight as recited in claim 8, wherein each framing member has a lighting channel that extends into the inward face of the first vertical portion and a lighting lens that extends into and covers the lighting channel.

10. A skylight assembly, comprising:

an outer frame, the outer frame having framing members that define an interior space, the framing members each having a bottom portion, a first vertical portion that extends upwardly from the bottom portion and has an inward face, an outward face, and a first vertical portion top, a second vertical portion that extends upwardly from the bottom portion and has a second vertical portion top, the second vertical portion is parallel to and shorter than the first vertical portion, and an upper support shelf that extends inwardly from the top of the second vertical portion, the upper support shelf having an upper support surface, the outer frame further has a lower support shelf associated with each of the framing members that extends inwardly, substantially parallel to and lower than the upper support shelf;

an inner frame, the inner frame including a longitudinal rafter that extends between the two of the framing members and two transverse rafters that each extend between one of the framing members and the longitudinal rafter, each rafter including a rafter top, rafter side edges, and a support block positioned on the rafter top and substantially centered between the rafter side edges, the support block having a pair of block sides and a block top; and at least four panes, each pane having:

at least one structural glass panel, spanning a portion of the interior space between one of the framing members, one of the transverse rafters, and one of the longitudinal rafters, having a lower edge that is supported by the upper support surface of said framing member and the block top of said transverse rafters, a panel of thermal glass having an upper edge, the thermal glass panel having a lower edge that is supported by the lower support shelf of the framing members and the rafter top of said rafters and extends parallel to the at least one structural glass panel, and a spacer, extending between the at least one structural glass panel and the panel of thermal glass, the spacer extending against and sealed to the lower edge of one of the panels of said at least one structural glass panel and the upper edge of the thermal glass panel to create an insulating glass unit between the thermal glass panel and said at least one structural glass panel.

11. The skylight assembly as recited in claim 10, wherein the outer frame further comprises a structural thermal break associated with each framing member, each structural thermal break has a box portion having a top, a bottom, and sides, the lower support shelf associated with said framing member extends from one of the sides of said box portion of said structural thermal break near the bottom of said box portion of said structural thermal break.

12. The skylight as recited in claim 11, wherein each structural thermal break has a downward clasp at the top, wherein the upper support shelf of each framing member has an upward clasp, and wherein the downward clasp of each of the structural thermal breaks is mated with the upward clasp of one of the framing members.

13. The skylight as recited in claim 12, further comprising a glass setting block, the glass setting block made of a gasket material, the glass setting block following a contour provided by the upper support surface, the structural thermal break, and the lower support shelf, the glass setting block extending between the upper support surface and one panel of the at least one structural glass panel, and between the lower support shelf and the thermal glass panel.

14. The skylight as recited in claim 13, further comprising a pair of rafter glass setting blocks associated with the at least one rafter, the rafter glass setting block made of a gasket material, secured to the rafter top, and extending on the rafter top between one of the thermal glass panels and the rafter top, upwardly along one of the block sides, and partially across the block top between the at least one structural glass panel panels and block top.

15. The skylight as recited in claim 14, wherein each framing member has a flashing overhang that has a horizontal leg that extends laterally outwardly from the first vertical portion, and a downward leg that extends downwardly from and perpendicular to the horizontal leg fully opposite from the first vertical portion.

16. The skylight as recited in claim 15, wherein the outer frame includes two framing members that extend parallel to and abut each other, and further comprising a bottom plate that has an outer panel that extends downwardly, an inner panel that extends upwardly, and a horizontal panel that extends between the inner panel and outer panel, the bottom plate extends underneath both of said framing members that abut each other with the horizontal panel extending against the bottom of said framing members, the inner panel extending against the second vertical portions of said framing members, and the inner panel extending against the downward leg of the flashing overhang of said framing members.

17. A skylight assembly, comprising:

an outer frame, the outer frame having framing members that define an interior space, the framing members each having a bottom portion, a first vertical portion that extends upwardly from the bottom portion and has an inward face, an outward face, and a first vertical portion top, a second vertical portion that extends upwardly from the bottom portion and has a second vertical portion top, the second vertical portion is parallel to and shorter than the first vertical portion, and an upper support shelf that extends inwardly from the top of the second vertical portion, the upper support shelf having an upper support surface, the outer frame further has a lower support shelf associated with each of the framing members that extends inwardly, substantially parallel to and lower than the upper support shelf;

at least one structural glass panel, spanning a portion of the interior space, having a lower edge that is supported by the upper support surface;

a thermal glass panel having an upper edge, the thermal glass panel having a lower edge that is supported by the lower support shelf and extends parallel to the at least one structural glass panel; and a spacer, extending between the at least one structural glass panel and the panel of thermal glass, the spacer extending against and sealed to the lower edge of one of the panels of said at least one structural glass panel and the upper edge of the thermal glass panel to create an insulating glass unit between the thermal glass panel and said at least one structural glass panel.

18. The skylight assembly as recited in claim 17, wherein the outer frame further comprises:

a structural thermal break associated with each framing member, each structural thermal break has a box portion having a top, a bottom, and sides, the lower support shelf associated with said framing member extends from one of the sides of said box portion of said structural thermal break near the bottom of said box portion of said structural thermal break; and a base frame member having a base support surface, the bottom of the box portion resting on the base support surface so that the base frame member provides load bearing support for the structural thermal break and the framing members.

19. The skylight assembly as recited in claim 18, further comprising a glass setting block, the glass setting block made of a gasket material, the glass setting block following a contour provided by the upper support surface, the structural thermal break, and the lower support shelf, the glass setting block extending between the upper support surface and one panel of the at least one structural glass panel, and between the lower support shelf and the thermal glass panel.

20. The skylight assembly as sa recited in claim 19, wherein each structural thermal break has a downward clasp at the top of the box portion and an upward clasp on the lower support shelf, wherein the upper support shelf of each framing member has an upward clasp, wherein the base support surface has a downward clasp, wherein the downward clasp of each of the structural thermal breaks is mated with the upward clasp of one of the framing members, and wherein the downward clasp of each of the base frame members is mated with the upward clasp of one of the structural thermal breaks.

* * * * *